US009939750B2

(12) United States Patent
Narita et al.

(10) Patent No.: US 9,939,750 B2
(45) Date of Patent: Apr. 10, 2018

(54) CHARGING MEMBER, PROCESS CARTRIDGE, AND IMAGE-FORMING APPARATUS FOR REDUCING SMALL COLOR LINES

(71) Applicant: FUJI XEROX Co., Ltd., Tokyo (JP)

(72) Inventors: Kosuke Narita, Kanagawa (JP); Hiroyuki Miura, Kanagawa (JP); Toru Ogawa, Kanagawa (JP); Tomoko Suzuki, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/443,367

(22) Filed: Feb. 27, 2017

(65) Prior Publication Data

US 2018/0011415 A1 Jan. 11, 2018

(30) Foreign Application Priority Data

Jul. 7, 2016 (JP) ..... 2016-135252

(51) Int. Cl.
*G03G 15/02* (2006.01)
*G03G 21/18* (2006.01)

(52) U.S. Cl.
CPC ..... *G03G 15/0216* (2013.01); *G03G 21/1814* (2013.01)

(58) Field of Classification Search
CPC ..... G03G 15/0216
USPC ..... 399/176
See application file for complete search history.

(56) References Cited

U.S. PATENT DOCUMENTS 6,001,519 A * 12/1999 Yang ..... B82Y 10/00 365/112
6,066,427 A * 5/2000 Black ..... C09B 67/0016 430/135
6,614,243 B2 * 9/2003 Klehn ..... G01R 1/06738 324/754.21
2003/0228166 A1 * 12/2003 Nakagawa ..... G03G 15/0216 399/66
2012/0224887 A1 * 9/2012 Harada ..... G03G 15/0233 399/168
2015/0277244 A1 * 10/2015 Sato ..... G03G 5/04 399/159

FOREIGN PATENT DOCUMENTS

JP 2007-065320 A 3/2007
JP 2008-256908 A 10/2008
JP 2009-145665 A 7/2009

* cited by examiner

*Primary Examiner* — Quana M Grainger
(74) *Attorney, Agent, or Firm* — Sughrue Mion, PLLC

(57) ABSTRACT

A charging member includes a support, a conductive elastic layer disposed on the support, and a surface layer disposed on the conductive elastic layer. Domains with current values of 2.5 pA or more have an average size of about 300 nm or less in a binary image created using a current value of 2.5 pA as a threshold from current measured by contacting a conical probe having a tip diameter of 20 nm with an outer surface of the surface layer and applying a voltage of 3 V between the conical probe and the support while moving the conical probe.

13 Claims, 6 Drawing Sheets

CHARGING MEMBER, PROCESS CARTRIDGE, AND IMAGE-FORMING APPARATUS FOR REDUCING SMALL COLOR LINES

CROSS-REFERENCE TO RELATED APPLICATIONS

This application is based on and claims priority under 35 USC 119 from Japanese Patent Application No. 2016-135252 filed Jul. 7, 2016.

BACKGROUND

(i) Technical Field

The present invention relates to charging members, process cartridges, and image-forming apparatuses.

(ii) Related Art

There are known charging members, for use in electrophotographic image-forming apparatuses, that include at least a conductive elastic layer on a support.

SUMMARY

According to an aspect of the invention, there is provided a charging member including a support, a conductive elastic layer disposed on the support, and a surface layer disposed on the conductive elastic layer. Domains with current values of 2.5 pA or more have an average size of about 300 nm or less in a binary image created using a current value of 2.5 pA as a threshold from current measured by contacting a conical probe having a tip diameter of 20 nm with an outer surface of the surface layer and applying a voltage of 3 V between the conical probe and the support while moving the conical probe.

BRIEF DESCRIPTION OF THE DRAWINGS

Exemplary embodiments of the present invention will be described in detail based on the following figures, wherein.

DETAILED DESCRIPTION

Exemplary embodiments of the invention will now be described. The exemplary embodiments and examples described herein are for illustration purposes only and are not intended to limit the scope of the invention.

In the present specification, if there is more than one material corresponding to any type of component in a composition, the content of that type of component in the composition refers to the total content of the corresponding materials in the composition unless otherwise specified.

In the present specification, "electrophotographic photoreceptor" may be simply referred to as "photoreceptor". In the present specification, the "axial direction" of a charging member refers to the direction of the axis of rotation of the charging member.

In the present specification, "small color line" refers to an unintended linear image with a length on the order of millimeters that appears in a halftone image.

Charging Member

A charging member according to one exemplary embodiment includes a support, a conductive elastic layer disposed on the support, and a surface layer disposed on the conductive elastic layer. That is, the charging member according to this exemplary embodiment includes at least the conductive elastic layer and the surface layer on the support.

The charging member according to this exemplary embodiment may be of any shape. For example, the charging member according to this exemplary embodiment may be a roller, as illustrated in FIG. 1, or may be a belt.

Figure 1:
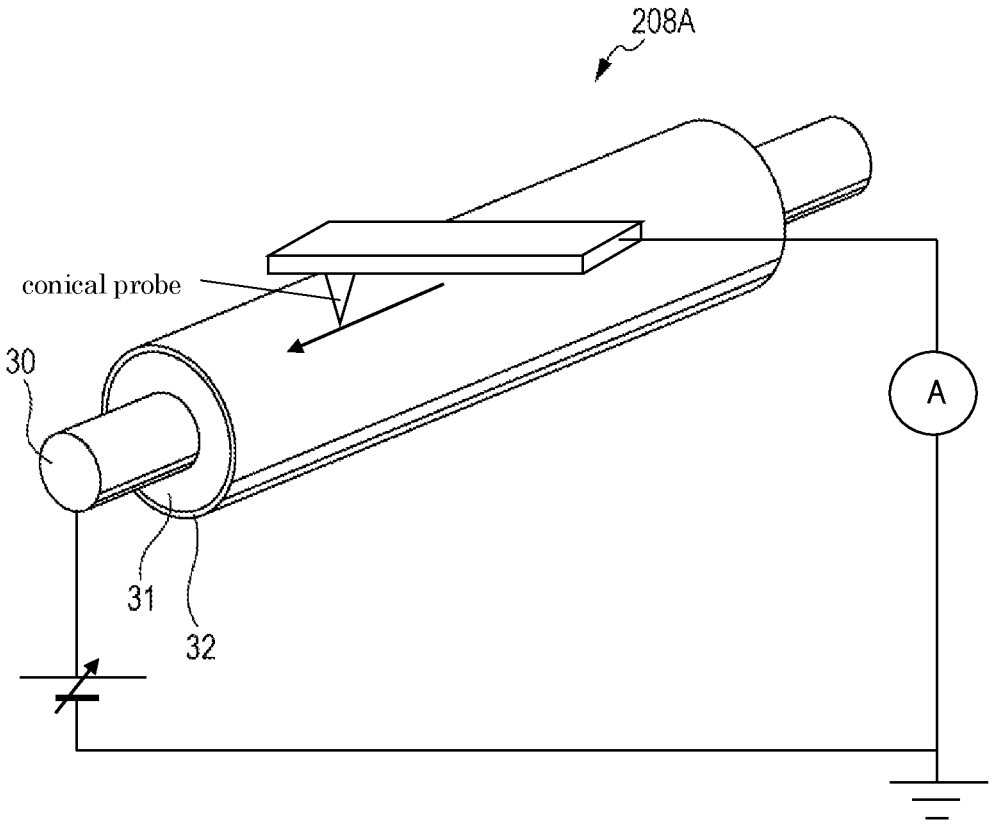
FIG. 1 is a schematic view of an example charging member according to one exemplary embodiment.

FIG. 1 shows an example charging member according to this exemplary embodiment. A charging member 208A shown in FIG. 1 includes a solid or hollow cylindrical support 30, a conductive elastic layer 31 disposed on the outer surface of the support 30, and a surface layer 32 disposed on the outer surface of the conductive elastic layer 31.

When a binary image of the charging member according to this exemplary embodiment is created using a current value of 2.5 pA as a threshold from the current measured by contacting a conical probe having a tip diameter of 20 nm with the outer surface of the surface layer 32 and applying a voltage of 3 V between the conical probe and the support 30 while moving the conical probe, domains with current values of 2.5 pA or more in the binary image have an average size of 300 nm or less or about 300 nm or less. A detailed description of the method of current measurement is given in the Examples section.

Figure 2A:
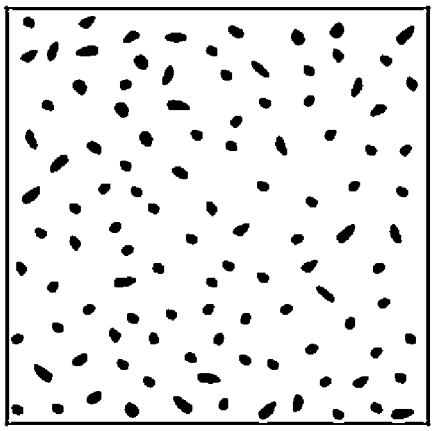
FIG. 2A is a schematic illustration of an example binary image.
Figure 2B:
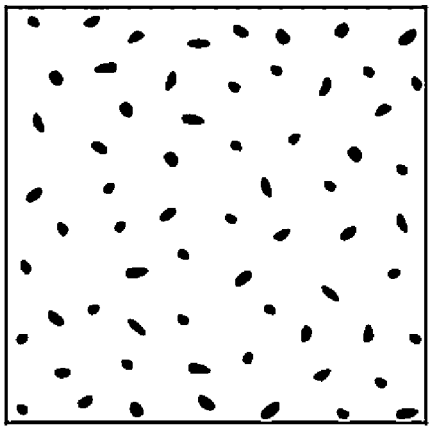
FIG. 2B is a schematic illustration of an example binary image.
Figure 2C:
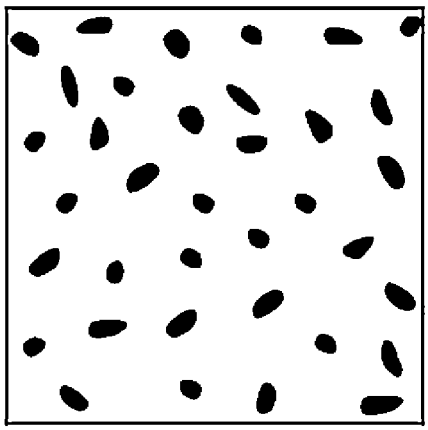
FIG. 2C is a schematic illustration of an example binary image.

FIGS. 2A, 2B, and 2C are schematic illustrations of example binary images created using a current value of 2.5 pA as a threshold. In FIGS. 2A, 2B, and 2C, domains with current values of 2.5 pA or more, shown in black, are dispersed in a domain with a current value of less than 2.5 pA.

FIGS. 2A and 2B are example binary images where domains with current values of 2.5 pA or more have an average size of 300 nm or less or about 300 nm or less. FIG. 2C is an example binary image where domains with current values of 2.5 pA or more have an average size of more than 300 nm. The charging members that give the binary images in FIGS. 2A and 2B may cause fewer small color lines when used in a contact-charging image-forming apparatus than the charging member that gives the binary image in FIG. 2C. Although the mechanism is not fully understood, reducing the average size of domains with current values of 2.5 pA or more as measured by the method described above to 300 nm or less or about 300 nm or less may alleviate uneven discharge and thus reduce small color lines. The charging member that gives the binary image in FIG. 2C will cause small color lines because abnormal discharge will occur locally due to the presence of excessively large domains with current values of 2.5 pA or more.

Although the domains with current values of 2.5 pA or more in the binary image in this exemplary embodiment have an average size of 300 nm or less or about 300 nm or less, they may have a smaller size, preferably 200 nm or less or about 200 nm or less, more preferably 50 nm or less or about 50 nm or less. It should be noted that the domains with current values of 2.5 pA or more have sizes of 20 nm or more since the current is measured using a conical probe having a tip diameter of 20 nm.

The average size of the domains with current values of 2.5 pA or more in the binary image may be controlled to 300 nm or less or about 300 nm or less, for example, by using conductive particles with good dispersibility in the binder resin used to form the surface layer 32, by adjusting the content of conductive particles in the composition used to form the surface layer 32, by adjusting the drying temperature during the formation of the surface layer 32, or by adjusting the thickness of the surface layer 32, as will be described in detail later.

Although the domains with current values of 2.5 pA or more in the binary images in FIGS. 2A and 2B have average sizes of 300 nm or less or about 300 nm or less, the binary images in FIGS. 2A and 2B differ in how the domains are distributed. The binary image in FIG. 2A contains a larger number of domains than the binary image in FIG. 2B. In this exemplary embodiment, the domains with current values of 2.5 pA or more, which have an average size of 300 nm or less or about 300 nm or less, may be densely distributed to further reduce small color lines. As a measure of this, it is preferred that a total current of 30 nA or more or about 30 nA or more, more preferably 35 nA or more or about 35 nA or more, even more preferably 45 nA or more or about 45 nA or more, flow through a 50 μm square (50 μm×50 μm square) area as measured by contacting a conical probe having a tip diameter of 20 nm with the outer surface of the surface layer 32 and applying a voltage of 3 V between the conical probe and the support 30 while moving the conical probe. The total current is preferably limited to 150 nA or less or about 150 nA or less, more preferably 100 nA or less or about 100 nA or less, even more preferably 55 nA or less or about 55 nA or less, to prevent a photoreceptor from being overcharged.

Domains with current values of 2.5 pA or more in a 50 μm square area in a binary image preferably have a total area of from 1 to 50 $\mu m^2$, more preferably from 5 to 30 $\mu m^2$, even more preferably from 10 to 20 $\mu m^2$, to further reduce small color lines.

The individual components of the charging member according to this exemplary embodiment will now be specifically described.

Support

The support is a conductive member that functions as an electrode and as a support for the charging member. The support may be solid or hollow.

Examples of supports include metal members such as iron (e.g., free-cutting steel), copper, brass, stainless steel, aluminum, and nickel members; iron members coated with metals such as chromium and nickel; resin and ceramic members coated with metals; and resin and ceramic members containing conductors.

Conductive Elastic Layer

The conductive elastic layer is disposed on the support. The conductive elastic layer may be disposed on the outer surface of the support either directly or an adhesive layer therebetween.

The conductive elastic layer may be composed of a single layer or a stack of layers. The conductive elastic layer may be a foamed conductive elastic layer, an unfoamed conductive elastic layer, or a stack of foamed and unfoamed conductive elastic layers.

An example conductive elastic layer contains an elastic material, a conductor, and other additives.

Examples of elastic materials include polyurethane, nitrile rubber, isoprene rubber, butadiene rubber, ethylene-propylene rubber, ethylene-propylene-diene rubber, epichlorohydrin rubber, epichlorohydrin-ethylene oxide rubber, epichlorohydrin-ethylene oxide-allyl glycidyl ether rubber, styrene-butadiene rubber, acrylonitrile-butadiene rubber, chloroprene rubber, chlorinated polyisoprene, hydrogenated polybutadiene, butyl rubber, silicone rubber, fluoroelastomer, natural rubber, and mixtures thereof. Preferred among these elastic materials are polyurethane, silicone rubber, nitrile rubber, epichlorohydrin rubber, epichlorohydrin-ethylene oxide rubber, epichlorohydrin-ethylene oxide-allyl glycidyl ether rubber, ethylene-propylene-diene rubber, acrylonitrile-butadiene rubber, and mixtures thereof.

Examples of conductors include electronic conductors and ionic conductors. Examples of electronic conductors include various powders, including carbon blacks such as furnace black, thermal black, channel black, Ketjen black, acetylene black, and color black; pyrolytic carbon; graphite; metals and alloys such as aluminum, copper, nickel, and stainless steel; metal oxides such as tin oxide, indium oxide, titanium oxide, tin oxide-antimony oxide solid solutions, and tin oxide-indium oxide solid solutions; and insulating materials surface-treated to be conductive. Examples of ionic conductors include chlorates and perchlorates of ammoniums such as tetraethylammonium, lauryltrimethylammonium, and benzyltrialkylammonium; and chlorates and perchlorates of alkali metals such as lithium and alkaline earth metals such as magnesium. Such conductors may be used alone or in combination.

The conductor may have a primary particle size of from 1 to 200 nm.

The content of an electronic conductor in the conductive elastic layer is preferably from 1 to 30 parts by weight, more preferably from 15 to 25 parts by weight, per 100 parts by weight of the elastic material. The content of an ionic conductor in the conductive elastic layer is preferably from 0.1 to 5 parts by weight, more preferably from 0.5 to 3 parts by weight, per 100 parts by weight of the elastic material.

Examples of other additives that may be present in the conductive elastic layer include softeners, plasticizers, curing agents, vulcanizing agents, vulcanization accelerators, accelerator activators, antioxidants, surfactants, coupling agents, and fillers.

Examples of vulcanization accelerators include thiazoles, thiurams, sulfenamides, thioureas, dithiocarbamates, guanidines, and aldehyde-ammonias. Such vulcanization accelerators may be used alone or in combination.

The content of the vulcanization accelerator in the conductive elastic layer is preferably from 0.01 to 10 parts by weight, more preferably from 0.1 to 6 parts by weight, per 100 parts by weight of the elastic material.

Examples of accelerator activators include zinc oxide and stearic acid. Such accelerator activators may be used alone or in combination.

The content of the accelerator activator in the conductive elastic layer is preferably from 0.5 to 20 parts by weight, more preferably from 1 to 15 parts by weight, per 100 parts by weight of the elastic material.

Examples of fillers that may be present in the conductive elastic layer include calcium carbonate, silica, and clay minerals. Such fillers may be used alone or in combination.

The content of the filler in the conductive elastic layer is preferably from 5 to 60 parts by weight, more preferably from 10 to 60 parts by weight, per 100 parts by weight of the elastic material.

The conductive elastic layer preferably has a thickness of from 1 to 10 mm, more preferably from 2 to 5 mm. The conductive elastic layer preferably has a volume resistivity of from $1\times10^{3}$ to $1\times10^{14}$ Ωcm.

The conductive elastic layer may have an outer surface with a 10-point average roughness Rz (JIS B 0601:1994) of from 3.0 to 7.0 μm or from about 3.0 to about 7.0 μm to reduce small color lines. If the conductive elastic layer has an outer surface with a 10-point average roughness Rz of 3.0 μm or more or about 3.0 μm or more, undulations reflecting its roughness appear in the outer surface of the surface layer. Such undulations may reduce toner contamination and may thus alleviate uneven discharge and reduce small color lines. If the conductive elastic layer has an outer surface with a 10-point average roughness Rz of 7.0 μm or less or about 7.0 μm or less, moderate undulations appear in the outer surface of the surface layer and may thus alleviate uneven discharge and reduce small color lines.

In view of the above, the conductive elastic layer preferably has an outer surface with a 10-point average roughness Rz (JIS B 0601:1994) of from 3.5 to 6.0 μm or from about 3.5 to about 6.0 μm, more preferably from 4.0 to 5.5 μm or from about 4.0 to about 5.5 μm. The 10-point average roughness Rz of the outer surface of the conductive elastic layer may be controlled by polishing.

Examples of adhesive layers that may be present between the conductive elastic layer and the support include resin layers. Specific examples of adhesive layers include resin layers such as polyolefin, acrylic resin, epoxy resin, polyurethane, nitrile rubber, chlorinated rubber, vinyl chloride resin, vinyl acetate resin, polyester, phenolic resin, and silicone resin layers. The adhesive layer may contain a conductor (e.g., any electronic or ionic conductor listed above).

The conductive elastic layer may be formed on the support, for example, by extruding a conductive elastic layer composition containing an elastic material, a conductor, and other additives together with a cylindrical support from an extruder to form a layer of the conductive elastic layer composition on the outer surface of the support and then heating the layer of the conductive elastic layer composition to crosslink it into a conductive elastic layer. Alternatively, the conductive elastic layer may be formed on the support by extruding a conductive elastic layer composition containing an elastic material, a conductor, and other additives onto the outer surface of an endless belt support from an extruder to form a layer of the conductive elastic layer composition on the outer surface of the support and then heating the layer of the conductive elastic layer composition to crosslink it into a conductive elastic layer. The support may have an adhesive layer on the outer surface thereof.

Surface Layer

The surface layer is intended, for example, to reduce the contamination of the charging member with contaminants such as toner.

An example surface layer contains a binder resin, particles, and other additives. The particles present in the surface layer may be dispersed in the binder resin.

Examples of binder resins for the surface layer include polyamides, polyimides, polyesters, polyethylene, polyurethanes, phenolic resins, silicone resins, acrylic resins, melamine resins, epoxy resins, polyvinylidene fluoride, tetrafluoroethylene copolymers, polyvinyl butyral, ethylene-tetrafluoroethylene copolymers, fluoroelastomers, polycarbonates, polyvinyl alcohol, polyvinylidene chloride, polyvinyl chloride, ethylene-vinyl acetate copolymers, and cellulose. Such binder resins may be used alone or in combination.

Examples of particles that may be present in the surface layer include conductive particles. The conductive particles that may be present in the surface layer may have a volume resistivity of $1\times10^{9}$ Ωcm or less. Examples of conductive particles include carbon black and metal oxides such as tin oxide, titanium oxide, and zinc oxide.

The conductive particles that may be present in the surface layer preferably have a primary particle size of from 5 to 100 nm, more preferably from 10 to 50 nm, to achieve good dispersibility in a binder resin and thus allow the average size of domains with current values of 2.5 pA or more in a binary image to be easily controlled to 300 nm or less or about 300 nm or less.

Tin oxide may be used as the conductive particles, either alone or in combination with carbon black. Tin oxide has good dispersibility in a binder resin and thus allows the average size of domains with current values of 2.5 pA or more in a binary image to be easily controlled to 300 nm or less or about 300 nm or less. In this exemplary embodiment, the content of tin oxide in the surface layer is preferably from 10 to 100 parts by weight, more preferably from 30 to 70 parts by weight, even more preferably from 45 to 65 parts by weight, per 100 parts by weight of the binder resin. The content of carbon black in the surface layer is preferably from 0.1 to 5.0 parts by weight, more preferably from 1.0 to 3.0 parts by weight, per 100 parts by weight of the binder resin.

The surface layer may contain particles other than conductive particles for purposes such as controlling the surface properties of the charging member. Examples of such particles include resin particles such as polyamide particles, fluoropolymer particles, and silicone resin particles. For example, polyamide particles may be used to reduce small color lines. These resin particles may be used alone or in combination.

The resin particles, such as polyamide particles, that may be present in the surface layer may have a primary particle size of from 3 to 10 μm to achieve good dispersibility in a binder resin.

The content of the resin particles, such as polyamide particles, in the surface layer is preferably from 3 to 50 parts by weight, more preferably from 10 to 30 parts by weight, per 100 parts by weight of of the binder resin.

The surface layer preferably has a thickness of from 2 to 10 μm, more preferably from 3 to 8 μm. A thinner surface layer tends to give a binary image where domains with current values of 2.5 pA or more have a smaller average size.

The surface layer may have a volume resistivity of from $1\times10^{5}$ to $1\times10^{8}$ Ωcm.

The surface layer may be formed on the conductive elastic layer, for example, by applying a surface layer composition containing a binder resin, particles, and other additives to the conductive elastic layer to form a layer of the surface layer composition and then drying the layer of the surface layer composition. The surface layer composition may be applied to the conductive elastic layer by processes such as dip coating, roller coating, blade coating, wire bar coating, spray coating, bead coating, air knife coating, and curtain coating.

In the process of forming the surface layer, a higher heating temperature during the drying of the surface layer composition tends to give a binary image where domains with current values of 2.5 pA or more have a larger average size. The heating temperature may be adjusted to from 60° C. to 100° C. to control the average size of domains with current values of 2.5 pA or more in a binary image to 300 nm or less or about 300 nm or less. The heating time may be from 15 to 60 minutes.

Image-Forming Apparatus, Charging Device, and Process Cartridge

An image-forming apparatus according to one exemplary embodiment includes a photoreceptor, a charging device that includes a charging member according to one exemplary embodiment and that charges the photoreceptor by contact charging, a latent-image forming device that forms a latent image on a surface of the charged photoreceptor, a developing device that develops the latent image formed on the surface of the photoreceptor with a developer containing a toner to form a toner image on the surface of the photoreceptor, and a transfer device that transfers the toner image from the surface of the photoreceptor to a recording medium.

The charging device in the image-forming apparatus according to this exemplary embodiment may be of a type in which a direct-current voltage is applied alone to the charging member or may be of a type in which an alternating-current voltage superimposed on a direct-current voltage is applied to the charging member.

In general, contact charging devices tend to cause small color lines because of the low discharge frequency of a discharge phenomenon that occurs on the side toward which the photoreceptor moves immediately after the contact of the charging member with the photoreceptor (called "post-discharge"). In addition, the discharge frequency of post-discharge is lower for a type in which a direct-current voltage is applied alone to the charging member than for a type in which an alternating-current voltage superimposed on a direct-current voltage is applied to the charging member. This often results in irregular formation of insufficiently charged regions in the outer surface of the charging member, thus causing small color lines.

The charging device according to this exemplary embodiment, which includes a charging member according to one exemplary embodiment, may cause fewer small color lines even if the surface of the photoreceptor is charged by contact charging or a direct-current voltage is applied alone to the charging member.

The image-forming apparatus according to this exemplary embodiment may further include at least one device selected from a fixing device that fixes a toner image to a recording medium, a cleaning device that cleans the surface of the photoreceptor after the transfer of a toner image and before charging, and an erase device that exposes the surface of the photoreceptor to light to erase any charge on the photoreceptor after the transfer of a toner image and before charging.

The image-forming apparatus according to this exemplary embodiment may be a direct-transfer apparatus, which directly transfers a toner image from the surface of the photoreceptor to a recording medium. Alternatively, the image-forming apparatus according to this exemplary embodiment may be an intermediate-transfer apparatus, which transfers a toner image from the surface of the photoreceptor to a surface of an intermediate transfer member and then transfers the toner image from the surface of the intermediate transfer member to a surface of a recording medium.

A process cartridge according to one exemplary embodiment is a cartridge attachable to and detachable from an image-forming apparatus and including at least a photoreceptor and a charging member according to one exemplary embodiment. The process cartridge according to this exemplary embodiment may further include at least one device selected from a developing device, a photoreceptor cleaning device, a photoreceptor erase device, a transfer device, and other devices.

The configurations of image-forming apparatuses, charging devices, and process cartridges according to some exemplary embodiments will now be described with reference to the drawings.

Figure 3:
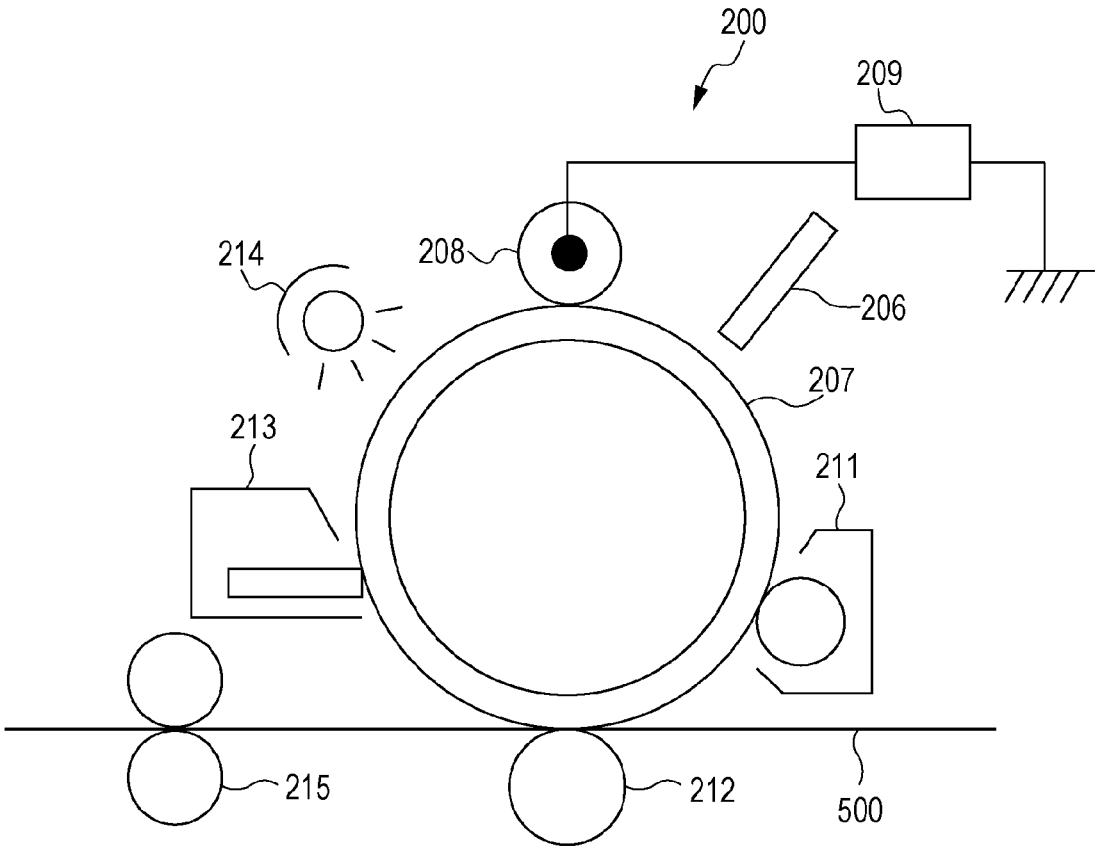
FIG. 3 is a schematic view of an example image-forming apparatus according to one exemplary embodiment.
Figure 4:
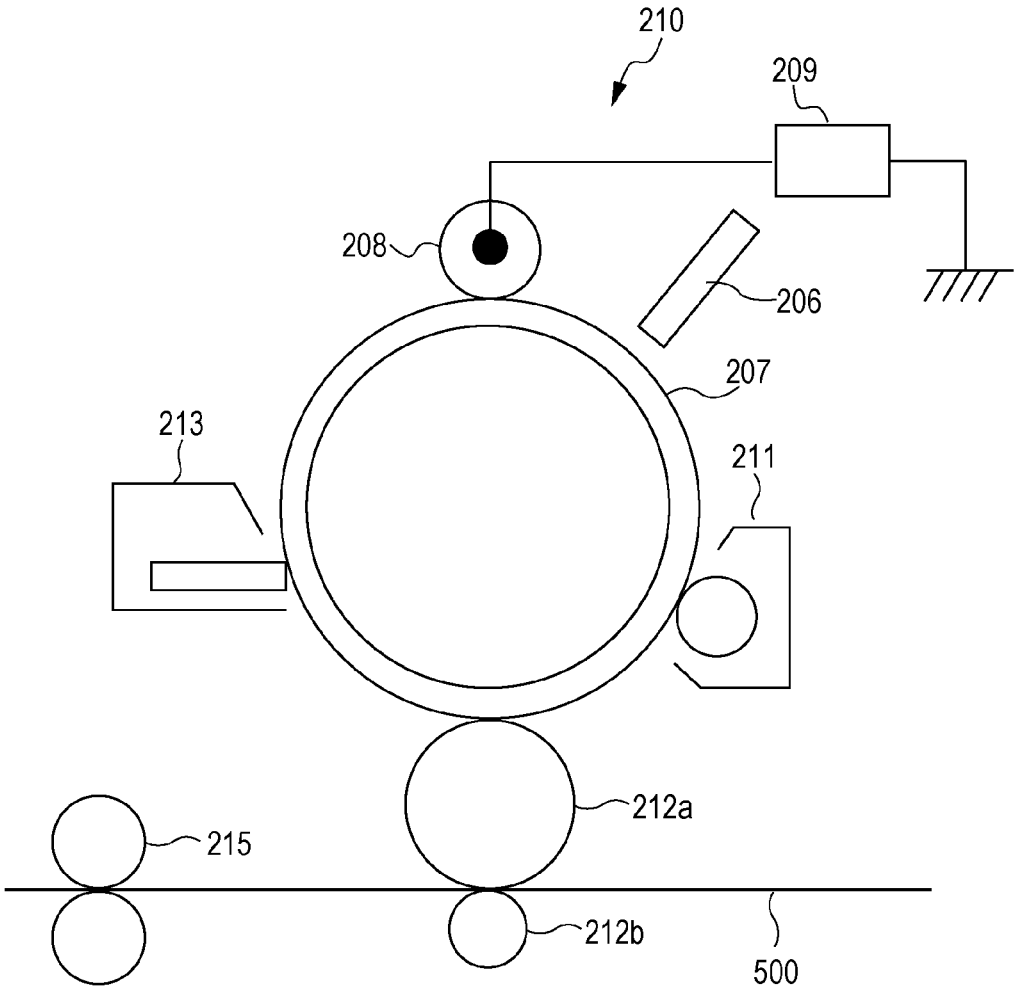
FIG. 4 is a schematic view of an example image-forming apparatus according to one exemplary embodiment.

FIG. 3 is a schematic view of a direct-transfer image-forming apparatus serving as an example image-forming apparatus according to one exemplary embodiment. FIG. 4 is a schematic view of an intermediate-transfer image-forming apparatus serving as an example image-forming apparatus according to one exemplary embodiment.

An image-forming apparatus 200 shown in FIG. 3 includes a photoreceptor 207, a charging device 208 that charges the surface of the photoreceptor 207, a power supply 209 connected to the charging device 208, an exposure device 206 that exposes the surface of the photoreceptor 207 to light to form a latent image, a developing device 211 that develops the latent image on the photoreceptor 207 with a developer containing a toner, a transfer device 212 that transfers the toner image from the photoreceptor 207 to a recording medium 500, a fixing device 215 that fixes the toner image to the recording medium 500, a cleaning device 213 that removes residual toner from the photoreceptor 207, and an erase device 214 that erases any charge on the surface of the photoreceptor 207. The erase device 214 may be omitted.

An image-forming apparatus 210 shown in FIG. 4 includes a photoreceptor 207, a charging device 208, a power supply 209, an exposure device 206, a developing device 211, first and second transfer members 212*a* and 212*b* that transfer a toner image from the photoreceptor 207 to a recording medium 500, a fixing device 215, and a cleaning device 213. As with the image-forming apparatus 200, the image-forming apparatus 210 may include an erase device.

The charging device 208 is a contact charging device including a charging roller disposed in contact with the surface of the photoreceptor 207 to charge the surface of the photoreceptor 207. The power supply 209 applies a direct-current voltage alone to the charging device 208 or applies an alternating-current voltage superimposed on a direct-current voltage to the charging device 208.

The exposure device 206 may be an optical device including a light source such as a semiconductor laser or a light-emitting diode (LED).

The developing device 211 is a device that supplies a toner to the photoreceptor 207. For example, the developing device 211 includes a developer-carrying roller disposed in contact with or adjacent to the photoreceptor 207 and deposits a toner on a latent image on the photoreceptor 207 to form a toner image.

The transfer device 212 may be, for example, a corona discharge generator or a conductive roller that is pressed against the photoreceptor 207 with the recording medium 500 therebetween.

The first transfer member 212*a* may be, for example, a conductive roller that is rotated in contact with the photoreceptor 207. The second transfer member 212*b* may be, for example, a conductive roller that is pressed against the first transfer member 212*a* with the recording medium 500 therebetween.

The fixing device 215 may be, for example, a heat fixing device including a heating roller and a pressing roller that is pressed against the heating roller.

The cleaning device 213 may be a device including a cleaning member such as a blade, brush, or roller. For example, the cleaning device 213 may include a cleaning blade made of urethane rubber, neoprene rubber, or silicone rubber.

The erase device 214 may be, for example, a device that exposes the surface of the photoreceptor 207 to light to erase residual charge on the photoreceptor 207 after transfer. The erase device 214 may be omitted.

Figure 5:
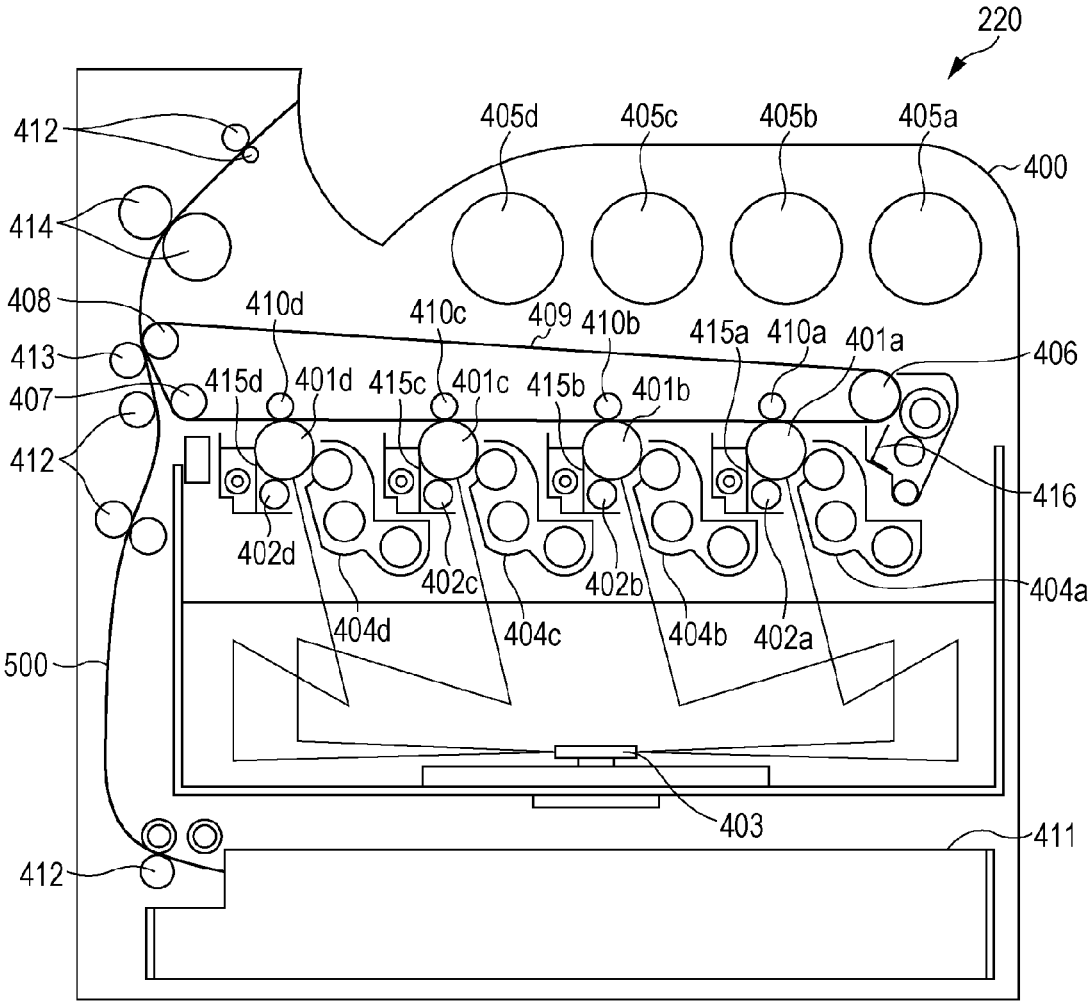
FIG. 5 is a schematic view of an example image-forming apparatus according to one exemplary embodiment.

FIG. 5 is a schematic view of a tandem intermediate-transfer image-forming apparatus serving as an example image-forming apparatus according to one exemplary embodiment. This image-forming apparatus includes four image-forming units arranged in parallel.

An image-forming apparatus 220 includes a housing 400 in which are disposed four image-forming units for different toners, an exposure device 403 including a laser light source, an intermediate transfer belt 409, a second transfer roller 413, a fixing device 414, and a cleaning device including a cleaning blade 416.

Since the four image-forming units have the same configuration, an image-forming unit including a photoreceptor 401*a* will be described herein as a representative example.

Disposed around the photoreceptor 401*a* are, in sequence in the rotational direction of the photoreceptor 401*a*, a charging roller 402*a*, a developing device 404*a*, a first transfer roller 410*a*, and a cleaning blade 415*a*. The first transfer roller 410*a* is pressed against the photoreceptor 401*a* with the intermediate transfer belt 409 therebetween. The developing device 404*a* is supplied with a toner from a toner cartridge 405*a*.

The charging roller 402*a* is a contact charging device disposed in contact with the surface of the photoreceptor 401*a* to charge the surface of the photoreceptor 401*a*. A power supply applies a direct-current voltage alone to the charging roller 402*a* or applies an alternating-current voltage superimposed on a direct-current voltage to the charging roller 402*a*.

The intermediate transfer belt 409 is tensioned over a drive roller 406, a tension roller 407, and a backup roller 408 and runs as they rotate.

The second transfer roller 413 is positioned to be pressed against the backup roller 408 with the intermediate transfer belt 409 therebetween.

The fixing device 414 is, for example, a heat fixing device including a heating roller and a pressing roller.

The cleaning blade 416 removes residual toner from the intermediate transfer belt 409. The cleaning blade 416 is disposed downstream of the backup roller 408 and removes residual toner from the intermediate transfer belt 409 after transfer.

A tray 411 containing recording media 500 is disposed in the housing 400. A recording medium 500 is transported by transport rollers 412 from the tray 411 to the contact area between the intermediate transfer belt 409 and the second transfer roller 413 and then to the fixing device 414, which fixes an image to the recording medium 500. After fixing, the recording medium 500 is output from the housing 400.

Figure 6:
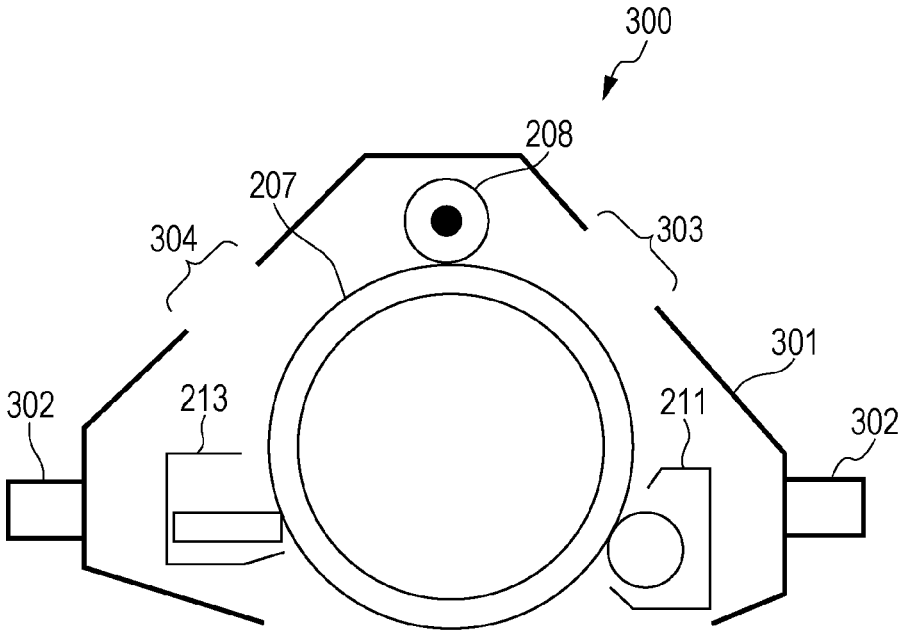
FIG. 6 is a schematic view of an example process cartridge according to one exemplary embodiment.

FIG. 6 is a schematic view of an example process cartridge according to one exemplary embodiment. For example, a process cartridge 300 shown in FIG. 6 is attachable to and detachable from the body of an image-forming apparatus including an exposure device, a transfer device, and a fixing device.

The process cartridge 300 includes a photoreceptor 207, a charging device 208, a developing device 211, and a cleaning device 213 that are combined together by a housing 301. The housing 301 has mounting rails 302 for attachment to and detachment from an image-forming apparatus, an opening 303 for exposure, and an opening 304 for erase exposure.

The charging device 208 in the process cartridge 300 is a contact charging device including a charging roller disposed in contact with the surface of the photoreceptor 207 to charge the surface of the photoreceptor 207. When the process cartridge 300 is attached to an image-forming apparatus and is used to form an image, a power supply applies a direct-current voltage alone to the charging device 208 or applies an alternating-current voltage superimposed on a direct-current voltage to the charging device 208.

Developer and Toner

The image-forming apparatuses according to the foregoing exemplary embodiments may use any developer. The developer may be a one-component developer, which contains only a toner, or may be a two-component developer, which contains a toner and a carrier.

The developer may contain any toner. The toner contains, for example, a binder resin, a colorant, and a release agent. Examples of binder resins for toners include polyesters and styrene-acrylic resins.

The toner may contain an external additive. Examples of external additives for toners include organic particles such as silica, titania, and alumina.

The toner is prepared by manufacturing toner particles and adding an external additive to the toner particles. The toner particles may be manufactured by processes such as pulverization, aggregation coalescence, suspension polymerization, and dissolution suspension. The toner particles may be single-layer toner particles or core-shell toner particles, which are composed of a core (core particle) and a coating (shell layer) covering the core.

The toner particles preferably have a volume average particle size (D50v) of from 2 to 10 μm, more preferably from 4 to 8 μm.

The two-component developer may contain any carrier. Examples of carriers include coated carriers, which are magnetic powders, serving as a core, that are coated with resins; dispersed-magnetic-powder carriers, which are magnetic powders dispersed in matrix resins; and resin-impregnated carriers, which are porous magnetic powders impregnated with resins.

The mixing ratio (weight ratio) of the toner to the carrier in the two-component developer is preferably from 1:100 to 30:100, more preferably from 3:100 to 20:100.

EXAMPLES

The exemplary embodiments of the invention are further illustrated by the following non-limiting examples. In the description below, parts are by weight unless otherwise specified.

Fabrication of Charging Roller

Example 1

Formation of Conductive Elastic Layer

- Epichlorohydrin rubber (the trade name Hydrin T3106, Zeon Corporation) 100 parts
- Carbon black (the trade name Asahi #60, Asahi Carbon Co., Ltd.) 6 parts Ionic conductor (the trade name BTEAC, Lion Specialty Chemicals Co., Ltd.) 5 parts Vulcanizing agent: sulfur (the trade name VULNOC R, Ouchi Shinko Chemical Industrial Co., Ltd.) 1 part Accelerator activator: stearic acid 1 part Accelerator activator: zinc oxide 1.5 parts Calcium carbonate (the trade name WHITON SB, Shiraishi Calcium Kaisha, Ltd.) 20 parts The foregoing ingredients are compounded on an open mill to obtain a composition. The composition is molded onto the outer surface of a shaft (SUS303, 8 mm in diameter) having an adhesive layer using a press-molding machine to form a roller having a diameter of 13 mm. The roller is then heated at 170° C. for 70 minutes to obtain a conductive elastic layer roller. The conductive elastic layer is then polished to a diameter of 12 mm.

Measurement of 10-Point Average Roughness Rz

The 10-point average roughness Rz of the conductive elastic layer roller is measured in the center in the axial direction in accordance with JIS B 0601:1994 using a surface roughness meter (the trade name SURFCOM 1400A, Tokyo Seimitsu Co., Ltd.). The measurement conditions are as follows: the scan direction is the axial direction, the scan rate is 0.3 mm/sec, the measurement length is 4.0 mm, and the cutoff is 0.08 mm.

Formation of Surface Layer

Binder resin: N-methoxymethylated nylon (the trade name F30K, Nagase ChemteX Corporation) 100 parts Particle A: carbon black (the trade name Ketjen black EC300J, Lion Specialty Chemicals Co., Ltd., average primary particle size: 39 nm) 2 parts Particle B: tin oxide (the trade name S-2000, Mitsubishi Materials Corporation, average primary particle size: 18 nm) 50 parts Particle C: polyamide particles (the trade name Polyamide 12, Arkema Inc., average primary particle size: 5.0 μm) 20 parts The foregoing ingredients are mixed, diluted with methanol, and processed in a bead mill to obtain a dispersion. The dispersion is applied to the outer surface of the conductive elastic layer roller by dip coating and is then dried by heating at 75° C. for 30 minutes to obtain a charging roller having a surface layer with a thickness of 4 μm.

Current Measurement

The charging roller is allowed to stand in an environment at 23±2° C. and 50±5% RH for 24 hours or more before measurements are conducted in the same environment. The measurements are conducted in three areas (near both ends and in the center) in the axial direction of the charging roller and in four areas spaced at intervals of 90° in the circumferential direction, i.e., in a total of 12 areas. Each measurement area is a 50 μm×50 μm square area (with two sides extending parallel to the axial direction of the charging roller) in the outer surface of the surface layer. Current is measured by contacting a conical probe (made of tungsten) having a tip diameter of 20 nm with the outer surface of the surface layer and applying a voltage of 3 V between the conical probe and the shaft while moving the conical probe at a speed of 1 μm/sec in the axial direction of the charging roller. This measurement is repeated each time the conical probe is shifted in the circumferential direction of the charging roller by a distance equal to the tip diameter of the conical probe to measure the current throughout a 50 μm square area. A binary image is created that includes domains with current values of 2.5 pA or more and a domain with a current value of less than 2.5 pA. The equivalent circle diameter of each domain with a current value of 2.5 pA or more is calculated from the area thereof, and the average diameter of the domains with current values of 2.5 pA or more in the 50 μm square area is calculated. The average diameters of the domains with current values of 2.5 pA or more in all measurement areas (12 areas) are further averaged to determine the average size (nm) of the domains with current values of 2.5 pA or more.

The total current through each 50 μm square area is determined by the above measurements. The total currents through all measurement areas (12 areas) are averaged to determine the total current (nA) that flows through a 50 μm square area.

Examples 2 and 3

Charging rollers are fabricated as in Example 1 except that the polishing conditions for the conductive elastic layer are changed.

Example 4

A charging roller is fabricated as in Example 1 except that the thickness of the surface layer is changed to 7 μm.

Example 5

A charging roller is fabricated as in Example 1 except that the amount of tin oxide used to form the surface layer is changed to 70 parts, and the thickness of the surface layer is changed to 7 μm.

Examples 6 to 9

Charging rollers are fabricated as in Example 5 except that the polishing conditions for the conductive elastic layer are changed.

Example 10

A charging roller is fabricated as in Example 1 except that 70 parts of zinc oxide (average primary particle size: 28 nm, Tayca Corporation) is used instead of 50 parts of tin oxide to form the surface layer.

Example 11

A charging roller is fabricated as in Example 1 except that the amount of tin oxide used to form the surface layer is changed to 40 parts.

Example 12

A charging roller is fabricated as in Example 1 except that the amount of tin oxide used to form the surface layer is changed to 40 parts, and the thickness of the surface layer is changed to 7 μm.

Comparative Example 1

A charging roller is fabricated as in Example 1 except that the amount of tin oxide used to form the surface layer is changed to 70 parts, drying is performed by heating at 120° C. for 30 minutes, and the thickness of the surface layer is changed to 7 μm.

Comparative Example 2

A charging roller is fabricated as in Example 1 except that the amount of carbon black used to form the surface layer is changed to 12 parts, tin oxide is not used, and the thickness of the surface layer is changed to 7 μm.

Image Quality Evaluation

Small Color Lines

The charging rollers of the Examples and the Comparative Examples are each mounted on a modified DocuCentre 505a machine equipped with a contact charging device of a type in which a direct-current voltage is applied alone to the charging roller. A full-page halftone image with an area coverage of 30% is printed on 5,000 sheets of A4 paper in a high-temperature, high-humidity environment (at 28° C. and 85% RH). The last printed image is visually inspected in a 94 mm×200 mm upper left area and is rated on the following scale, where from G0 to G2 are acceptable. The results are shown in Table 1.

G0: no small color line
G0.5: 1 small color line
G1: 2 or 3 small color lines
G1.5: 4 or 5 small color lines
G2: from 6 to 10 small color lines
G2.5: from 11 to 13 small color lines
G3: from 14 to 20 small color lines
G3.5: from 21 to 23 small color lines
G4: 24 or more small color lines

TABLE 1

| | Surface layer | | | | | | | | Average size of domains with current values of 2.5 pA or more | Total current through 50 μm square area | Conductive elastic layer 10-point average roughness Rz | Image quality Small color lines |
|---|---|---|---|---|---|---|---|---|---|---|---|---|
| | Particle A | | Particle B | | Particle C | | Heat drying | Thickness | | | | |
| | Type | Amount | Type | Amount | Type | Amount | | | | | | |
| Example 1 | Carbon black | 2 parts | Tin oxide | 50 parts | Polyamide particles | 20 parts | 75° C./30 min | 4 μm | 32 nm | 52 nA | 5.1 μm | G0 |
| Example 2 | Carbon black | 2 parts | Tin oxide | 50 parts | Polyamide particles | 20 parts | 75° C./30 min | 4 μm | 34 nm | 51 nA | 3.3 μm | G0.5 |
| Example 3 | Carbon black | 2 parts | Tin oxide | 50 parts | Polyamide particles | 20 parts | 75° C./30 min | 4 μm | 34 nm | 50 nA | 6.8 μm | G0.5 |
| Example 4 | Carbon black | 2 parts | Tin oxide | 50 parts | Polyamide particles | 20 parts | 75° C./30 min | 7 μm | 152 nm | 65 nA | 5.2 μm | G1 |
| Example 5 | Carbon black | 2 parts | Tin oxide | 70 parts | Polyamide particles | 20 parts | 75° C./30 min | 7 μm | 286 nm | 72 nA | 5.2 μm | G1.5 |
| Example 6 | Carbon black | 2 parts | Tin oxide | 70 parts | Polyamide particles | 20 parts | 75° C./30 min | 7 μm | 282 nm | 68 nA | 3.3 μm | G1.5 |
| Example 7 | Carbon black | 2 parts | Tin oxide | 70 parts | Polyamide particles | 20 parts | 75° C./30 min | 7 μm | 280 nm | 70 nA | 6.8 μm | G1.5 |
| Example 8 | Carbon black | 2 parts | Tin oxide | 70 parts | Polyamide particles | 20 parts | 75° C./30 min | 7 μm | 282 nm | 71 nA | 2.6 μm | G2 |
| Example 9 | Carbon black | 2 parts | Tin oxide | 70 parts | Polyamide particles | 20 parts | 75° C./30 min | 7 μm | 284 nm | 75 nA | 7.3 μm | G2 |
| Example 10 | Carbon black | 2 parts | Zinc oxide | 70 parts | Polyamide particles | 20 parts | 75° C./30 min | 4 μm | 275 nm | 70 nA | 5.2 μm | G1.5 |
| Example 11 | Carbon black | 2 parts | Tin oxide | 40 parts | Polyamide particles | 20 parts | 75° C./30 min | 4 μm | 182 nm | 35 nA | 5.2 μm | G1.5 |
| Example 12 | Carbon black | 2 parts | Tin oxide | 40 parts | Polyamide particles | 20 parts | 75° C./30 min | 7 μm | 250 nm | 27 nA | 5.2 μm | G2 |
| Comparative Example 1 | Carbon black | 2 parts | Tin oxide | 70 parts | Polyamide particles | 20 parts | 120° C./30 min | 7 μm | 322 nm | 72 nA | 5.2 μm | G3 |
| Comparative Example 2 | Carbon black | 12 parts | None | | Polyamide particles | 20 parts | 75° C./30 min | 7 μm | 511 nm | 102 nA | 5.5 μm | G4 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member comprising:

a support;

a conductive elastic layer disposed on the support; and a surface layer disposed on the conductive elastic layer, wherein domains with current values of 2.5 pA or more have an average size of about 300 nm or less in a binary image from current measured by contacting a conical probe having a tip diameter of 20 nm with an outer surface of the surface layer and applying a voltage of 3 V between the conical probe and the support while moving the conical probe, and wherein the domains comprise conductive particles.

2. The charging member according to claim 1, wherein the domains with current values of 2.5 pA or more in the binary image have an average size of about 200 nm or less.

3. The charging member according to claim 1, wherein the domains with current values of 2.5 pA or more in the binary image have an average size of about 50 nm or less.

4. The charging member according to claim 1, wherein a total current of about 30 nA or more flows through a 50 μm square area as measured by contacting a conical probe having a tip diameter of 20 nm with the outer surface of the surface layer and applying a voltage of 3 V between the conical probe and the support while moving the conical probe.

5. The charging member according to claim 1, wherein a total current of about 35 nA or more flows through a 50 μm square area as measured by contacting a conical probe having a tip diameter of 20 nm with the outer surface of the surface layer and applying a voltage of 3 V between the conical probe and the support while moving the conical probe.

6. The charging member according to claim 1, wherein a total current of about 45 nA or more flows through a 50 μm square area as measured by contacting a conical probe having a tip diameter of 20 nm with the outer surface of the surface layer and applying a voltage of 3 V between the conical probe and the support while moving the conical probe.

7. The charging member according to claim 1, wherein a total current of about 150 nA or less flows through a 50 μm square area as measured by contacting a conical probe having a tip diameter of 20 nm with the outer surface of the surface layer and applying a voltage of 3 V between the conical probe and the support while moving the conical probe.

8. The charging member according to claim 1, wherein a total current of about 100 nA or less flows through a 50 μm square area as measured by contacting a conical probe having a tip diameter of 20 nm with the outer surface of the surface layer and applying a voltage of 3 V between the conical probe and the support while moving the conical probe.

9. The charging member according to claim 1, wherein a total current of about 55 nA or less flows through a 50 μm square area as measured by contacting a conical probe having a tip diameter of 20 nm with the outer surface of the surface layer and applying a voltage of 3 V between the conical probe and the support while moving the conical probe.

10. The charging member according to claim 1, wherein the conductive elastic layer has an outer surface with a 10-point average roughness Rz (JIS B 0601:1994) of from about 3.0 to about 7.0 μm.

11. A process cartridge attachable to and detachable from an image-forming apparatus, the process cartridge comprising:

an electrophotographic photoreceptor; and a charging device that comprises the charging member according to claim 1 and that is configured to charge the electrophotographic photoreceptor by contact charging.

12. An image-forming apparatus comprising:

an electrophotographic photoreceptor;

a charging device that comprises the charging member according to claim 1 and that is configured to charge the electrophotographic photoreceptor by contact charging;

a latent-image forming device that is configured to form a latent image on a surface of the charged electrophotographic photoreceptor;

a developing device that is configured to develop the latent image formed on the surface of the electrophotographic photoreceptor with a developer comprising a toner to form a toner image on the surface of the electrophotographic photoreceptor; and a transfer device that is configured to transfer the toner image from the surface of the electrophotographic photoreceptor to a recording medium.

13. The image-forming apparatus according to claim 12, wherein a direct-current voltage is applied alone to the charging member of the charging device to charge the electrophotographic photoreceptor by contact charging.

* * * * *